United States Patent [19]

Leneveu et al.

[11] Patent Number: 4,519,855

[45] Date of Patent: May 28, 1985

[54] MIXED CHARGES FOR AMMUNITIONS WITH A CASING CONSTITUTED BY AGGLOMERATED PROPELLANT POWDER AND PROPELLANT POWDER IN GRAIN FORM

[75] Inventors: Louis J. J. Leneveu; Didier J. Treneules, both of Chateaulin, France

[73] Assignee: Societe Nationale des Poudres et Explosifs, Paris, France

[21] Appl. No.: 446,476

[22] Filed: Dec. 2, 1982

[30] Foreign Application Priority Data

Dec. 17, 1981 [FR] France ..... 81 23560

[51] Int. Cl.[3] ..... C06B 45/02

[52] U.S. Cl. ..... 149/21; 102/283; 102/288; 149/11; 149/12; 149/96; 149/100; 149/111

[58] Field of Search ..... 102/283, 288; 149/21, 149/11, 12, 96, 100, 111

[56] References Cited

U.S. PATENT DOCUMENTS 3,749,615 7/1973 Dorsey et al. ..... 149/21 X

*Primary Examiner*—Stephen J. Lechert, Jr.

*Attorney, Agent, or Firm*—Bucknam and Archer

[57] ABSTRACT

The present invention falls in the field of propellant charges for ballistic ammunitions which have combustible or a non-combustible casing. According to the invention, the ammunition is constituted by a casing 2 placed around a shell 1 and closed by a portion 3 which carries the primer 4. The casing contains a mixed charge constituted on one hand by fragmentable balls 5 and on the other hand, by grains 6 of propellant powder. The balls 5 are constituted by agglomerated propellant powder. The charges according to the invention may be prepared on an industrial scale very easily and in a very reproducible manner and they permit an appreciable increase of the coefficient of filling of the casing.

4 Claims, 4 Drawing Figures

MIXED CHARGES FOR AMMUNITIONS WITH A CASING CONSTITUTED BY AGGLOMERATED PROPELLANT POWDER AND PROPELLANT POWDER IN GRAIN FORM

The present invention relates to propellant charges for ballistic ammunitions of the type which has a combustible or a non-combustible casing.

Conventional propellant charges consist of grains of loose propellant powder in a combustible or a non-combustible casing. These charges are not progressive and this constitutes a drawback because if one traces the curve representing the variation of pressure within the weapon as a function of time at the time of ignition, the curve has the general behavior of a peak which increases very rapidly and then also equally very rapidly decreases.

In view of the fact that the maximum pressure developed in the weapon due to the propellant charge at the time of ignition, must in every case, remain inferior to the rupture limit of the tube of the weapon, this type of charge does not permit in general to obtain a good coefficient of filling of the casing.

Several efforts have been made in order to find more progressive charges, that is charges which lead to a curve, pressure as a function of time, which has the general behavior of a plateau rather than a peak so that it is possible to obtain a better coefficient of filling of the casing and consequently an initial rate of the projectile which is greater without risking rupturing the tube of the weapon. The choice of the propellant charge constitutes a possibility of solution of this problem. In fact, it has been possible to improve the progressitivity of the powder by partially relying on the geometry of the grain of the powder and in this manner, a grain of cylindrical powder having 19 orifices is more progressive than a grain of powder having 7 orifices, the latter being more progressive than monotubular grains of powder. On the other hand, it is possible to rely on the composition of the grain of the powder in view of the smoothing operations which permit to incorporate a moderator of combustion on the surface of the grain of powder. However, these possibilities are still insufficient for a great number of the charges.

It has also been proposed to prepare charges consisting of a cylindrical block which is fragmentable and made of agglomerated powder, which presents a central channel in which the propellant powder in the form of grains is placed. At the time of ignition, the propellant powder in the grains burns first causing the fragmentation of the cylindrical block which burns in turn as a loose powder. These charges are described for instance in French Pat. Nos. 2,374,278, 2,411,817, and 2,436,766 issued to Societe Nationale des Poudres et Explosifs. They permit to improve appreciably the coefficient of filling of the ammunition and, for the same ammunition of 30 mm caliber, for instance, they permit to increase the initial rate of the projectile from 780 meters/second up to 870 meters/second. However, these charges present two serious drawbacks. On one hand from the point of view of the ballistic performance, these charges present a poor conservation of performance as a result of the temperature (what is involved are cycles of temperature in the course of which the powder remains at different temperatures prior to being drawn to room temperature or temperature ranges). As a result, a great variation in results occurs. Another substantial drawback of these charges is that they are not suitable in the case of casings having a neck which presents a narrowing of the diameter at the level of the orifice of the charge. In fact, for this latter type of casing, the diameter of the fragmentable cylindrical block, smaller than the diameter of the body of the casing, in view of the contraction existing in the area of the orifice, lets a too great dead volume remain.

Another solution has also been proposed which leads to progressive charges, which are utilizable in ammunitions having a cylindrical casing, as well as in ammunitions which have a casing with a neck. This solution is described in French Pat. No. 2,214,672 and consists of providing a mixed charge constituted by a mixture on one hand of fragmentable propellant charges in the form of small tablets constituted by agglomerated powder, the dimensions of which are small in relationship to the dimension of the casing and on the other hand, propellant powder in the form of grains. This charge permits to improve the coefficient of filling of the ammunition, but does not permit to ensure a good reproducibility of results of the firing range because there is a lack of reproducibility in the distribution of the tablets in the interior of the casing. On the other hand, the industrial realization of this type of charge is not very convenient.

Finally, a solution has been proposed which consists of mixing powders of different nature with a liquid agglomerant, introducing this mixture in a casing and hardening the mixture by compression or heating according to the nature of the agglomerant. This solution is described in French Pat. No. 2,422,925 and permits to achieve a progressive charge which is utilizable in each type of casing and permits to improve the coefficient of filling, but it is not suitable for industrial application and it is not perfectly reproducible because it requires filling the casing with a mixture of slightly pasty consistency.

The object of the present invention is exactly to provide progressive charges for ammunitions with a casing utilizable with every type of casing and which permit to achieve a good coefficient of filling in a reproducible matter and suitable on an industrial scale and which offer a good behavior to temperature.

The crux of the present invention resides in the use of a mixed charge for ammunitions with a casing which is constituted by a mixture on one hand of fragmentable propellant charges constituted by agglomerated propellant powder and on the other hand by a propellant powder in the form of grains, the charge being characterized by the fact that the fragmentable charges are in the form of spheres, the diameter of which is less than the diameter of the orifice of the charge of the casing. According to a preferred embodiment of the invention, the diameter of the sphere is slightly lower than one-half of the diameter of the body of the casing.

The invention is described in detail by reference to the accompanying FIGS. 1–4 which illustrate particular embodiments.

Figure 1:
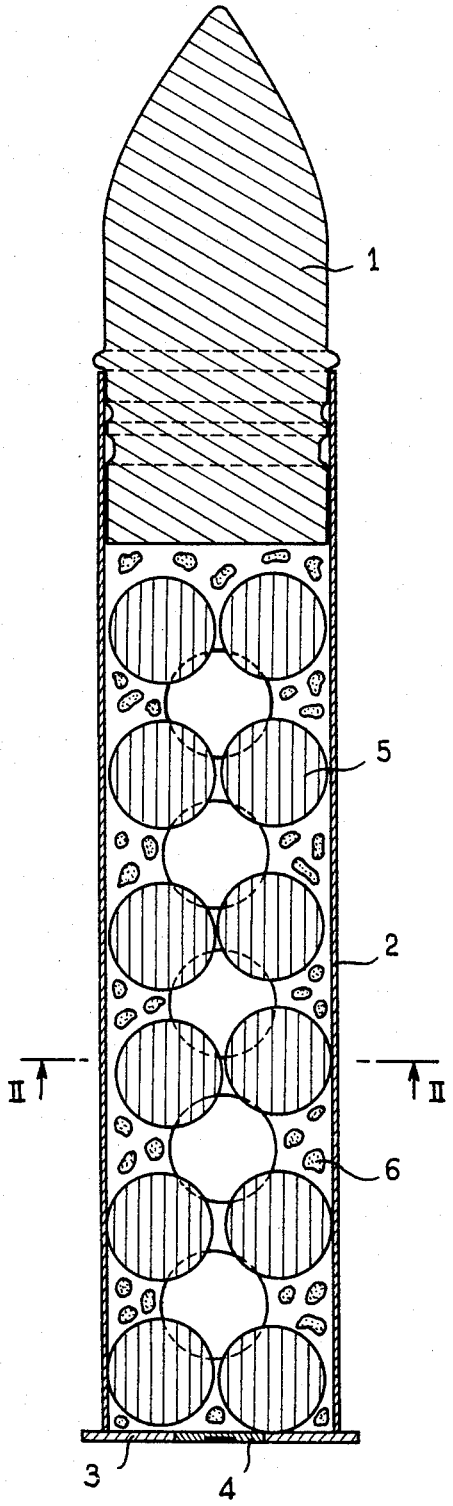
FIG. 1 is a longitudinal view in cross-section of an ammunition according to a preferred embodiment of the invention.

A progressive propellant charge according to the invention consists on one hand of fragmentable charges in the form of balls constituted by agglomerated propellant powder and on the other hand, by a propellant powder in the form of grains. In fact, it has been observed that the shape of the balls for the fragmentable charge is the shape which permits to achieve at the same time a good coefficient of filling and a great ease of filling of the casing on an industrial scale. The balls according to the invention are constituted of a propellant powder in the form of grains agglomerated by compression, in general, under the effect of heat. The propellant powder, in the form of grains which is intended for the preparation of the balls, is essentially selected as a function of the thermodynamic properties which are desired for the balls. For reasons of safety, one prefers to utilize powders, which do not contain nitroglycerine. Apart from this preference, one may utilize every propellant powder in the form of grains, which do not contain an ingredient subject to decomposition at the compression temperature. The actual fabrication of the balls is carried out either by compression of the grains of propellant powder alone which grains have been previously treated to be compressed as described for instance in French Pat. No. 2,374,278 or 2,436,766 or by compression of a mixture of grains of propellant powder and grains of a thermoplastic binder as described in French Pat. No. 2,411,817. The preferred method is the rapid compression, about 2 seconds under a pressure close to 100 bars at a temperature less than 110° C. of grains of smokeless powder containing nitrocellulose enveloped by a fine film of polyvinyl nitrate as described in French Pat. No. 2,436,766.

It is also possible to compress the powder either directly in the form of balls or in the form of one-half spheres which are then pasted in pairs, for instance by means of a collodion in a manner to form balls.

The dimension of the balls with respect to the casing in which the balls are placed is not without significance. First of all, it is necessary that the balls be of a diameter less than the diameter of the orifice of the charge of the casing and in the case of cylindrical casings, it is necessary that it be sufficiently smaller than the latter in order to permit to introduce the grains of propellant powder in a loose form in the entire casing on the side of the balls. However, and this is contrary to the teaching of French Pat. No. 2,214,672, it has also been found that it is not necessary in order to obtain the best ballistic performances that the diameter of the balls be small in comparison to the diameter of the body of the casing. On the contrary, applicants have found that the best ballistic performances are achieved when the diameter of the balls is slightly lower than one-half of the diameter of the body of the casing. In this case, the balls are positioned naturally in layers of two with the balls of layer n being disposed quincunically with respect to the balls of layer $n-1$ and $n+1$.

Clearly, the above arrangement is the preferred arrangement according to the invention, but the balls may have other diameters. The diameter of the ball may be superior to one-half the diameter of the body of the casing in which case one has layers which only contain a single ball provided that the diameter of the balls in every case, remains lower than the diameter of the body of the casing in such a manner to permit the addition of the grains of powder in loose form. The diameter of the balls may be equally less than one-half the diameter of the body of the casing and there are some cases in which it is possible to consider such diameters that one may have three and even four balls per layer. Applicants, however, have noted that as a general rule, it is not interesting from the ballistic point of view to place more than four balls per layer, that is utilizing balls of a diameter lower than the diameter which leads to an arrangement of four balls per layer.

Figure 2:
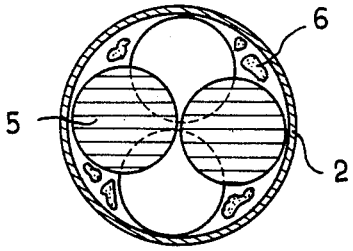
FIG. 2 illustrates a cross-section of the casing and the charge shown in FIG. 1 along lines II—II.
Figure 3:
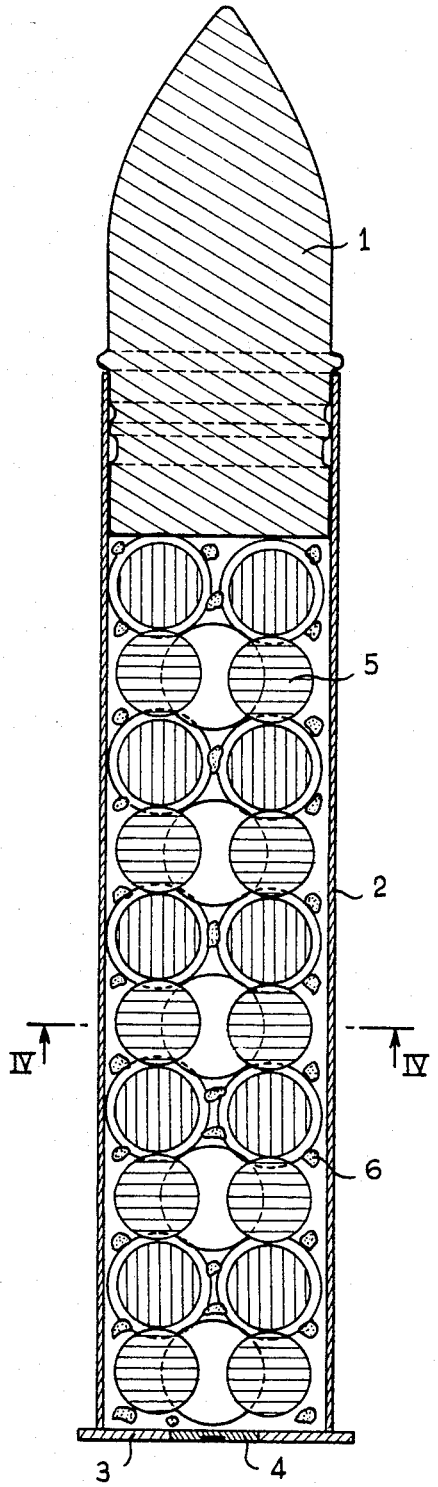
FIG. 3 is a longitudinal view in cross-section of another embodiment of the invention.
Figure 4:
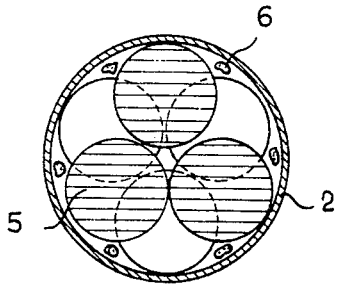
FIG. 4 is a cross-section along line IV—IV of the casing and the charge of FIG. 3.

By reference to FIGS. 1–4, they show ammunitions constituted by a shell 1 and a casing 2 mounted around the shell 1 and closed by the end portion 3, which carries primer 4, the mixed charge being constituted on one hand by fragmentable balls 5 and on the other hand by grains 6 of a propellant powder. FIGS. 1 and 2 show that the balls which have a dimaeter slightly less than one-half the diameter of the body of the casing 2, are arranged in layers of two disposed quincuncially in one layer with respect to the other layer. In the embodiments of FIGS. 3 and 4, the balls are arranged in layers of three disposed quincuncially one with respect to the other.

A charge in accordance with the present invention contains on the other hand, grains of propellant powder. The latter may be with respect to the powder which has served for the preparation of the fragmentable balls, identical, analogous or different. This powder is selected by one experienced in the art as a function of the ammunition and the ballistic performances which are desired. The only necessary requirement is with respect to the dimensions of the grains of the powder. The grains must be able to slide through the interstices which are present one one hand between the balls and on the other hand between the balls and the walls of the casings. In order to ensure an easy flow, it is advisable to utilize grains of dimensions which are substantially smaller than the interstices, a fact which leads to prefer, in general, monotubular powders. Although applicants do not wish to be limited by theoretical considerations, it appears that the functioning of the charges according to the invention is as follows: at the time of ignition, the grains of loose powder are ignited first and they cause the pressure in the interior of the casing to increase, a fact which causes the fragmentation of the balls which burn then as loose powder. The very good progressivity which is exhibited by the charges according to the invention, should be due to the shape of the fragmentable charges in the form of balls because the spherical form, is the shape for every given quantity of material which offers the minimum surface, which permits to slow-up at the maximum, the sparking and the ignition of the fragmentable charges.

The charges according to the invention may be utilized in every type of conventional casing such as for instance, cylindrical casings or casings having a neck, casings made of aluminum or brass, combustible or semi-combustible casings. In each instance, it is noted that for a given volume of the casing, there is a substantial increase in the coefficient of filling when the casing is charged with a charge according to the invention with respect to an identical casing charged in the same conventional manner with only the loose powder.

On the other hand, the charges according to the invention may be made industrially very easily and in a very reproducible manner because the balls position themselves within the casing simply as a result of the force of gravity and allow within each casing, the same volume to remain with the same geometrical configuration for the loose powders.

The invention is further illustrated by the examples set forth hereinbelow which, however, are not intended to limited the scope.

EXAMPLE 1

This example covers an ammunition of 30 mm caliber. The casing is a cylindrical casing made of brass of 77 mm utilizable length and 30 mm diameter. The shell weighs 243 grams and the primer is an electrical priming by means of a percussion-cap.

Fragmentable charges in the form of balls of diameter 14 mm are prepared. These balls have been manufactured using as a starting material grains of single base powder based on nitrocellulose of potential 900 calories per gram. The grains of powder are covered by a film of polyvinyl nitrate and are compressed in the form of ½ spheres according to the method described in French Pat. No. 2,436,766. The one-half spheres so obtained are best glued in pairs by pressing in the cold in the presence of a small amount of collodion containing nitrocellulose. In this manner, fragmentable spheres of diameter 14 mm and weight 2.4 grams are obtained. The casing is filled with 14 balls manufactured as described with a weight of 33.3 grams of energizing material in the form of fragmentable balls, the balls ranging in layers of two disposed quinconically one with respect to the other as described hereinabove. There is then added, 24.4 grams of grains of single base powder containing nitro-cellulose having potential of 980 calories per grams. In this manner, one succeeds in placing within the casing, a total of 58 grams of energizing material. The results of the firing are as follows:

Rate of the shell of the 25 m canon—835 meters per second;

Maximum pressure within the chamber of the weapon—2,590 bars.

There is also observed that the coefficients of temperature of the charges according to the invention are correct and that in several series of firings, one does not note any instance deviating in results, a fact which indicates the exceptional reliability of the charges according to the invention.

By way of comparison, if one fills the casing exclusively with grains of powder of potential 980 calories per gram, one can introduce a total of 48 grams of energizing material and the results of the firing are as follows:

Rate of the shell of the Canon of 25 meters—796 meters per second;

Maximum pressure within the chamber of the weapon—2,600 bars.

The invention, therefore, permits to gain 20% of energizing material with the same volume of casing, a fact which in the present case, causes a gain of about 40 meters per second on the rate of the shell without increasing appreciably the pressure within the chamber of the weapon.

EXAMPLES 2-4

These examples cover mixed charges with respect to ammunition of caliber of 30 mm analogous to that of Example 1 and are intended to illustrate the effect of the diameter of the spheres with respect to the diameter of the casing.

The spheres have been manufactured starting from grains of smokeless powder containing nitrocellulose of potential 900 calories per gram which powder has been glazed with 1.5% by weight of centralite and which has been graphitized with 0.2% of graphite. The grains of powder present themselves in the form of small cylinders with a central orifice and have the following dimensions:

length of the grain: 1.17 mm diameter of the grain: 1.02 mm diameter of the central orifice: 0.21 mm These grains of powder have been enveloped with a 2% by weight of polyvinyl nitrate and have been compressed in the form of spheres by means of a single compression carried out under the following conditions:

temperature of the mold: 110° C.

length of the pre-heating of the grains: 45 seconds compression pressure: 100 bars period of compression: 2 seconds Three types of balls have been prepared:

Example 2: diameter 14.7 mm, average weight 2.6 grams;

Example 3: diameter 13.5 mm, average weight 2.0 grams;

Example 4: diameter 12.0 mm, average weight 1.6 grams.

In this manner, mixed charges according to the invention are prepared with these three types of balls and with grains of a smokeless powder on nitrocellulose base of potential 900 calories per gram, glazed with 1.7% by weight of camphor and graphitized with 0.25% by weight of graphite, the grains of which in the form of a cylinder with a central orifice, have the following dimensions:

length of the grain: 1.76 mm;

diameter of the grain: 1.17 mm;

diameter of the central orifice: 0.22 mm

The charges exhibit the following properties:

| | Number of Balls | Manner of Arrangement of the Balls | Total Mass of the Balls | Weight of Loose Powder | Total Weight of the Energizing Material |
|---|---|---|---|---|---|
| Exh. 2 | 12 | 6 layers of 2 balls disposed quincuncially | 32 g | 29 g | 61 g |
| Exh. 3 | 18 | 6 layers of 3 balls disposed quincuncially | 36 g | 25 g | 61 g |
| Exh. 4 | 24 | 6 layers of 4 balls | 38.75 g | 22.25 g | 61 g |

The results of firing are the following:

| | Rate of the Shell of the Canon of 25 Meters | Maximum Pressure within the Chamber of the Weapon |
|---|---|---|
| Example 2 | 880 m/s ± 7 m/s | 2790 bars ± 98 bars |
| Example 3 | 890 m/s ± 12 m/s | 3055 bars ± 246 bars |
| Example 4 | 860 m/s ± 23 m/s | 2670 bars ± 306 bars |

These results show on one hand that it is possible due to the invention to obtain mixed charges which are utilizable in all types of casings and which permit with a 30 mm caliber to achieve rates in the order of from 870 up to 880 meters per second for the missile and on the other hand, that the more the diameter of the ball decreases, the more the dispersion of the results appears to increase.

What is claimed is:

1. A mixed charge for ammunition with a casing constituted by a mixture of fragmentable propellant charges constituted by propellant powder in agglomerated form and propellant powder in the form of grains, characterized by the fact that said fragmentable charges are in the form of spheres of diameter smaller than the diameter of the orifice of the charge of said casing and the number of the spheres per layer is 1, 2, 3 or 4.

2. The charge according to claim 1 characterized by the fact that the diameter of said spheres is slightly less than one-half the diameter of the body of said casing.

3. The charge according to claim 1 wherein the number of the spheres per layer is 2.

4. The charge according to claim 3 wherein the balls of one layer are arranged quincuncially with respect to each of the adjacent layers.

* * * * *